US007320536B2

(12) United States Patent
Petrakis et al.

(10) Patent No.: US 7,320,536 B2
(45) Date of Patent: Jan. 22, 2008

(54) FIRE RATED RECESSED LIGHTING ASSEMBLY

(75) Inventors: John Petrakis, St. Charles, IL (US); Aaron O'Brien, Munster, IN (US)

(73) Assignee: Juno Manufacturing, Inc., Des Plaines, IL (US)

( * ) Notice: Subject to any disclaimer, the term of this patent is extended or adjusted under 35 U.S.C. 154(b) by 116 days.

(21) Appl. No.: 11/276,578

(22) Filed: Mar. 6, 2006

(65) Prior Publication Data

US 2007/0206374 A1 Sep. 6, 2007

(51) Int. Cl.
*F21V 17/00* (2006.01)

(52) U.S. Cl. ..... 362/364; 362/362; 362/365; 362/147; 362/404

(58) Field of Classification Search ..... 362/364, 362/147, 148, 267, 153.1, 362, 365, 366, 362/404; 248/342, 343, 344; 277/650, 931, 277/933

See application file for complete search history.

(56) References Cited

U.S. PATENT DOCUMENTS 3,697,742 A * 10/1972 Bobrick ..... 362/366
6,105,334 A 8/2000 Monson et al.
6,357,891 B1 3/2002 Newbold et al.
6,838,618 B2 1/2005 Newbold et al.
7,208,677 B2 * 4/2007 Moselle ..... 174/50

OTHER PUBLICATIONS

Lamar, Adam, "What You Should Know About Fire-Rated Recessed Fixtures", homelighting.com, Jul. 23, 2003.
Capri Downlighting and Track Lighting "Capri Lighting", Nov. 7, 2003.
e.z. barrier, "The Only Fire-Rated Multi-Use Fire Barrier for Electrical Openings", no date.

(Continued)

*Primary Examiner*—Sandra O'Shea
*Assistant Examiner*—Mark Tsidulko
(74) *Attorney, Agent, or Firm*—Sonnenschein Nath & Rosenthal LLP

(57) ABSTRACT

A lighting assembly that includes a light fixture adapted to be disposed in relation to an opening defined in a surface of a structure such that a lamp may be installed in the light fixture through the opening, a trim having an outer surfaces, and an intumescent layer on the outer surface of the trim. The trim is adapted to engage the light fixture so that the outer surface of the trim on which the intumescent layer is disposed is positioned in proximity to the opening in the structure. The intumescent layer is adapted to expand to form a fire resistant seal between the trim and the structure when the intumescent layer reaches a predetermined temperature.

27 Claims, 8 Drawing Sheets

OTHER PUBLICATIONS

F6firefighter "6" Incandescent Fire Rated Housing", Nov. 14, 2003.
Astroflam Fire Seals Ltd. "Intumescent Downlighter Cover", no date.
Astro flame Fire Seals Ltd. "Luminaire Canopy Hood", no date.
Firefighter, by Fire Proof Inc. "The Best Solution for Fire-Rated Recessed Downlighting Applications", Aug. 14, 2003.
FIREDOME by Capri Lighting, Capri Lighting, 6" Recessed Fire Rated Incandescent Housing AirSeal™ and Non-IC Housing, FR6V150, C1-24 (rev. Sep. 2003), no date.
FIREDOME by Capri Lighting, "6" Recessed Fire Rated Compact Fluorescent Housing AirSeal™ and Non-IC Housing", FR6V13Q, FR6B18Q, C1-25 (rev. Oct. 2003), no date.
FIREDOME by Capri Lighting, "6" Recessed Fire Rated Compact Fluorescent Housing AirSeal™ and Non-IC Housing", FR6V2632U, C1-26 (rev. Oct. 2003), no date.
Elite Lighting, Incandescent Downlights, dated Aug. 14, 2003.

* cited by examiner

FIRE RATED RECESSED LIGHTING ASSEMBLY

FIELD OF THE INVENTION

The invention relates to a lighting assembly and, more particularly, to a fire rated lighting assembly that, when installed in a ceiling, floor, or wall structure of a room, inhibits a fire in the room from traveling through the structure via the recessed lighting assembly.

BACKGROUND OF THE INVENTION

Current residential and commercial buildings must generally comply with certain fire safety standards such as set forth by Underwriters Laboratories (UL), National Fire Protection Association (NFPA), or other administrative agency. For example, wood joists and sheet rock are typically used to create a finished room in a residential or commercial building. When using such materials, the building room or structure must typically satisfy a specific UL "fire-rated" assembly standard. For example, one applicable test is UL's 1 hr. Fire Rated L-500 Floor-Ceiling Assembly test. This test measures and rates a given floor-ceiling assembly for fire safety compliance, as related to flame containment and thermal transfer to adjacent joist spaces. Additional safety standards apply to recessed lighting assemblies or fixtures and electrical enclosures. UL 1598 is an example of a standard that is used to evaluate light fixtures for use in residential and commercial applications.

When installing a recessed lighting assembly in a ceiling structure, the lighting assembly is typically attached to the joist rafters or I-beams (e.g., "ceiling support members"). After making the proper electrical connections, drywall is usually attached to the ceiling support members concealing the recessed lighting assembly, The installer then cuts a hole; into a surface of the drywall of the ceiling to access the recessed lighting assembly below the ceiling surface for fixture lamping, and finished trim installation. As a result the recessed lighting assembly is positioned in relation to the ceiling surface to distribute light into the room.

However, one problem associated with installing a recessed lighting assembly in such a manner is that the hole cut in the surface can change the UL fire safety ratings of the floor-ceiling assembly as a result of the ceiling structure being breached. For or example, by cutting a hole into the ceiling, a non-continuous surface results and the floor-ceiling assembly may no longer satisfy certain UL fire safety standards. Allowing either flame, heat or both to enter the space above the floor-ceiling assembly may cause severe damage or total loss of the structure.

To overcome this problem when installing a recessed lighting assembly, a builder or installer may fabricate a conventional "fire box" around the recessed lighting assembly just prior to installation to create a continuous ceiling surface. The "fire box" is typically made from the same drywall used to form an adjacent ceiling. Most building inspectors interpret such a continuous ceiling surface as complying with all applicable fire standards as long as the appropriate materials are used. However, because the fire box is unattached and must be fabricated by the installer separately from the lighting assembly, a substantial amount of additional time, materials and expense can be incurred. Moreover, because most builders are unsure of the minimum size box to provide sufficient fire safety, exceedingly large boxes are typically utilized, causing unnecessary cost and expense.

Another conventional solution is to purchase prefabricated enclosures designed to fit between the ceiling support members. These prefabricated enclosures, however, are also often larger than necessary to enclose the recessed lighting assembly, causing unnecessary costs to be incurred.

Another conventional solution is to purchase and install recessed lighting assemblies that have been rated and UL, listed to maintain the fire rating when installed properly. These conventional assemblies typically include a light fixture enclosed with a separate or integrally formed box that contains a fire rated material such as disclosed in U.S. Pat. Nos. 6,105,334 and 6,357,891. The fire rated materials used for these enclosures typically include an aluminum support structure with fire rated drywall walls or a stamped metal structure with all internal bottom and wall surfaces having a cementitious or intumescent layer. However, the cost of these conventional preassembled recessed light fixtures is typically very high due to the labor and material expense required to fabricate the drywall panel walls and support structure or to stamp and coat all internal surfaces. In addition, the weight of each of these conventional preassembled recessed light fixtures increases the difficulty of installing the respective recessed lighting assembly.

Therefore, a need exists for a recessed lighting assembly that overcomes the problems noted above and others previously experienced for inhibiting a fire in a room from traveling through a ceiling, floor, or wall of the room via the recessed lighting assembly. These and other needs will become apparent to those of skill in the art after reading the present specification.

SUMMARY OF THE INVENTION

The foregoing problems are solved and a technical advance is achieved by the present invention. Articles of manufacture consistent with the present invention provide a lighting assembly. The lighting assembly includes a light fixture and a trim having an outer surface. The lighting fixture is adapted to be disposed in relation to an opening defined in a surface of a structure such that a lamp may be installed in the light fixture through the opening. The trim is adapted to engage the light fixture so that the outer surface of the trim is disposed in proximity to the opening in the structure. The lighting assembly further includes an intumescent layer disposed about at least a portion of the outer surface of the trim. The intumescent layer is adapted to expand to form a fire resistant seal between the trim and the structure when the intumescent layer reaches a predetermined temperature.

Articles of manufacture consistent with the present invention also provide a trim for mating to a lighting fixture. The light fixture is adapted to be disposed in relation to an opening defined in a surface of a structure such that a lamp may be installed in the light fixture through the opening. The trim comprises an outer surface and is adapted to engage the light fixture so that the outer surface of the trim is disposed in proximity to the opening in the structure. The trim further includes an intumescent layer disposed about at least a portion of the outer surface of the trim. The intumescent layer is adapted to expand to form a fire resistant seal between the trim and the structure when the intumescent layer reaches a predetermined temperature.

Other systems, apparatus, methods, features, and advantages of the present invention will be or will become apparent to one with skill in the art upon examination of the following figures and detailed description. It is intended that all such additional systems, methods, features, and advantages be included within this description be within the scope of the invention, and be protected by the accompanying claims.

BRIEF DESCRIPTION OF THE DRAWINGS

The accompanying drawings, which are incorporated in and constitute a part of this specification, illustrate an implementation of the present invention and, together with the description, serve to explain the advantages and principles of the invention. In the drawings.

DETAILED DESCRIPTION OF THE INVENTION

Reference will now be made in detail to an implementation consistent with the present invention as illustrated in the accompanying drawings. Wherever possible, the same reference numbers will be used throughout the drawings and the following description to refer to the same or like parts. As would be understood to one of ordinary skill in the art, certain components or elements for installation of a recessed light fixture (e.g., building support members, hanger arms, junction box, or electrical connections) are not shown in the figures or specifically noted herein to avoid obscuring the invention.

FIGS. 1-4 depict one embodiment of a lighting assembly 100 consistent with the present invention. The lighting assembly 100 includes a light fixture 102 and a trim 104 adapted to mate with or be installed on the light fixture 102. The trim 104 may have a cylindrical shape, a conical shape, or another shape adapted to allow light out of the light fixture. The trim 104 may include or be made from a fire resistant material.

Figure 1:
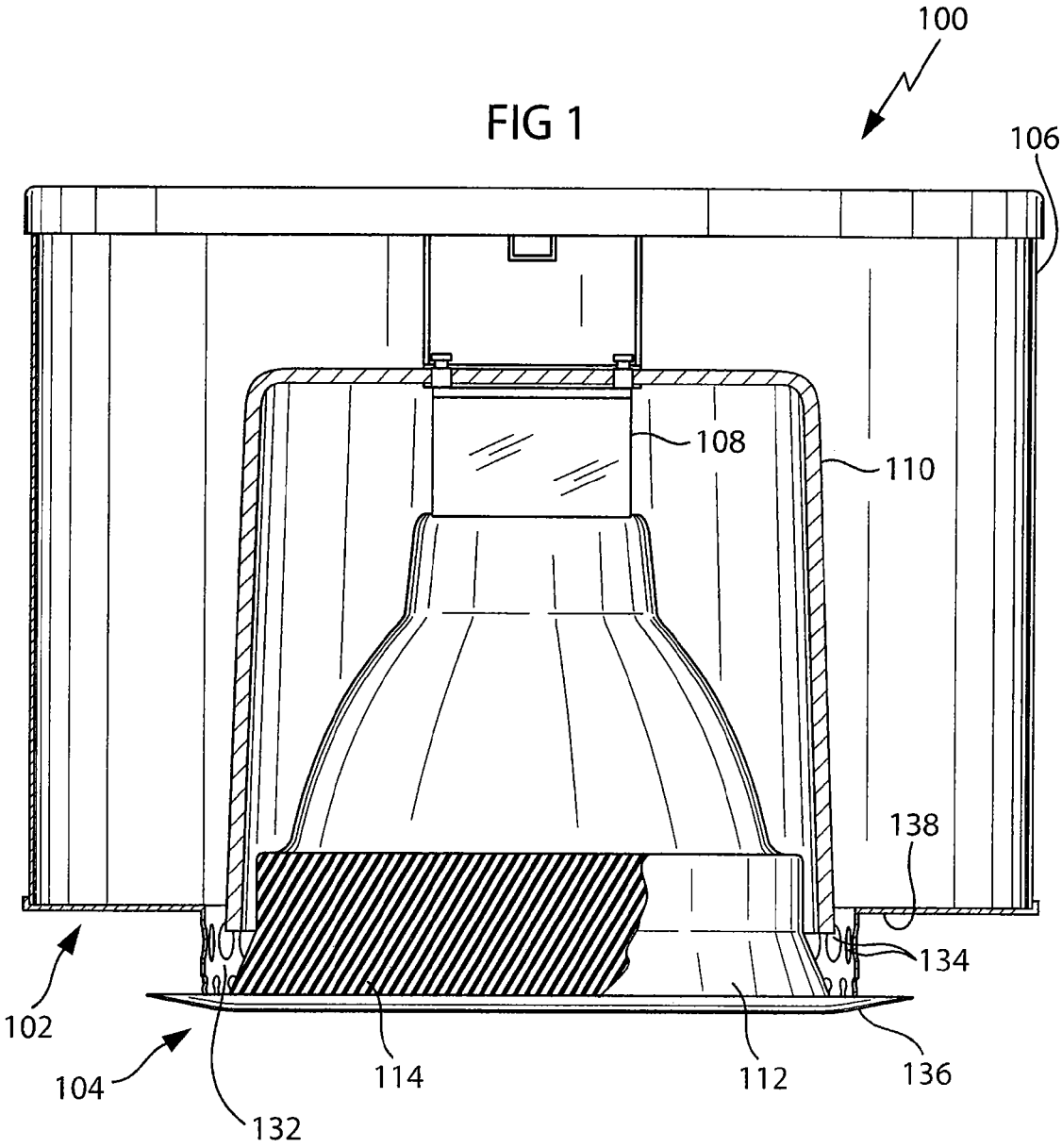
FIG. 1 is a side view with a cutaway portion of one embodiment of a lighting assembly including a light fixture and a trim having an intumescent layer or coating consistent with the present invention.
Figure 2:
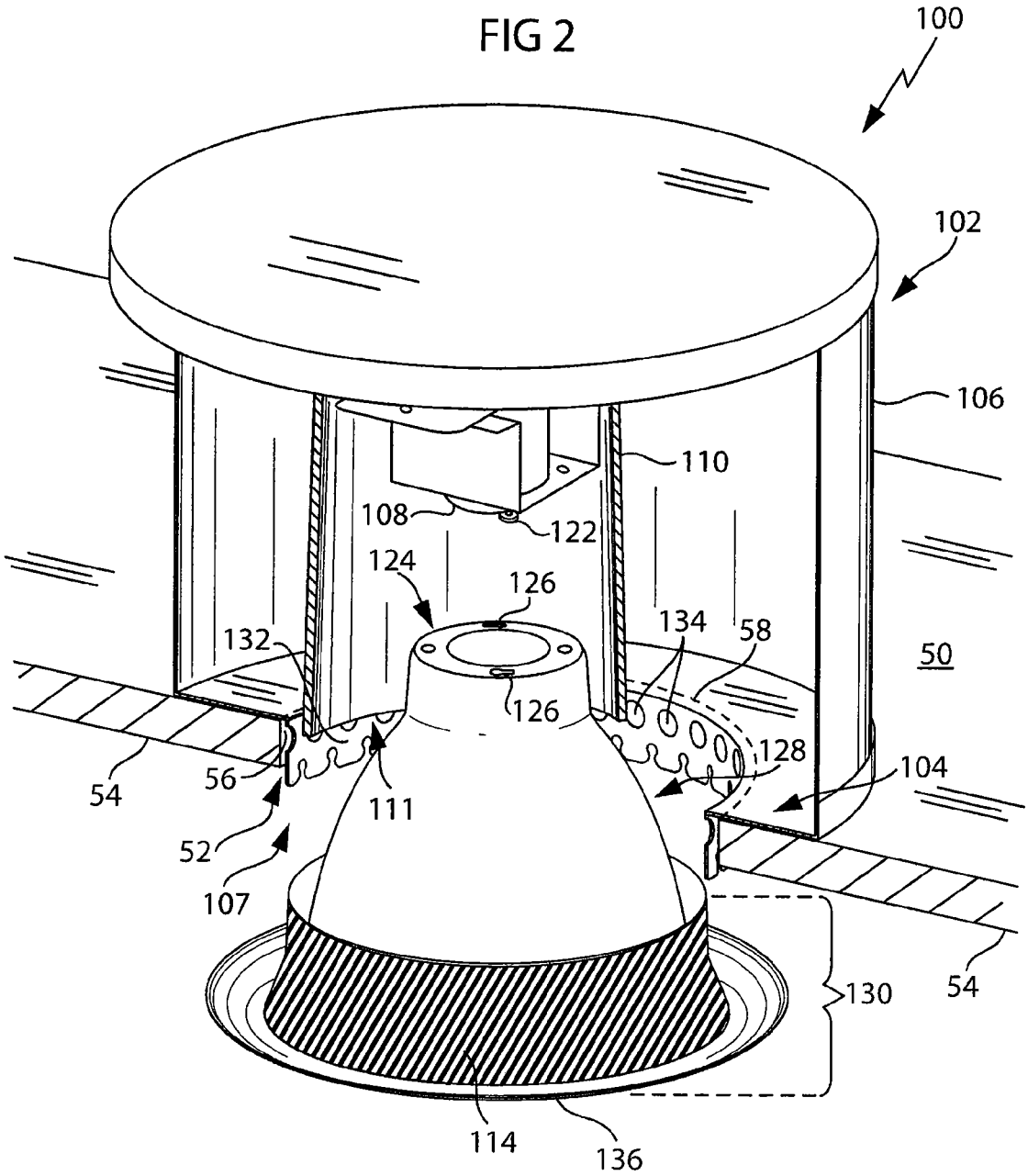
FIG. 2 is a perspective view with a cutaway portion of the lighting assembly in FIG. 1, where the light fixture is disposed in relation to an opening defined in a surface of a structure before installation of the trim.
Figure 3:
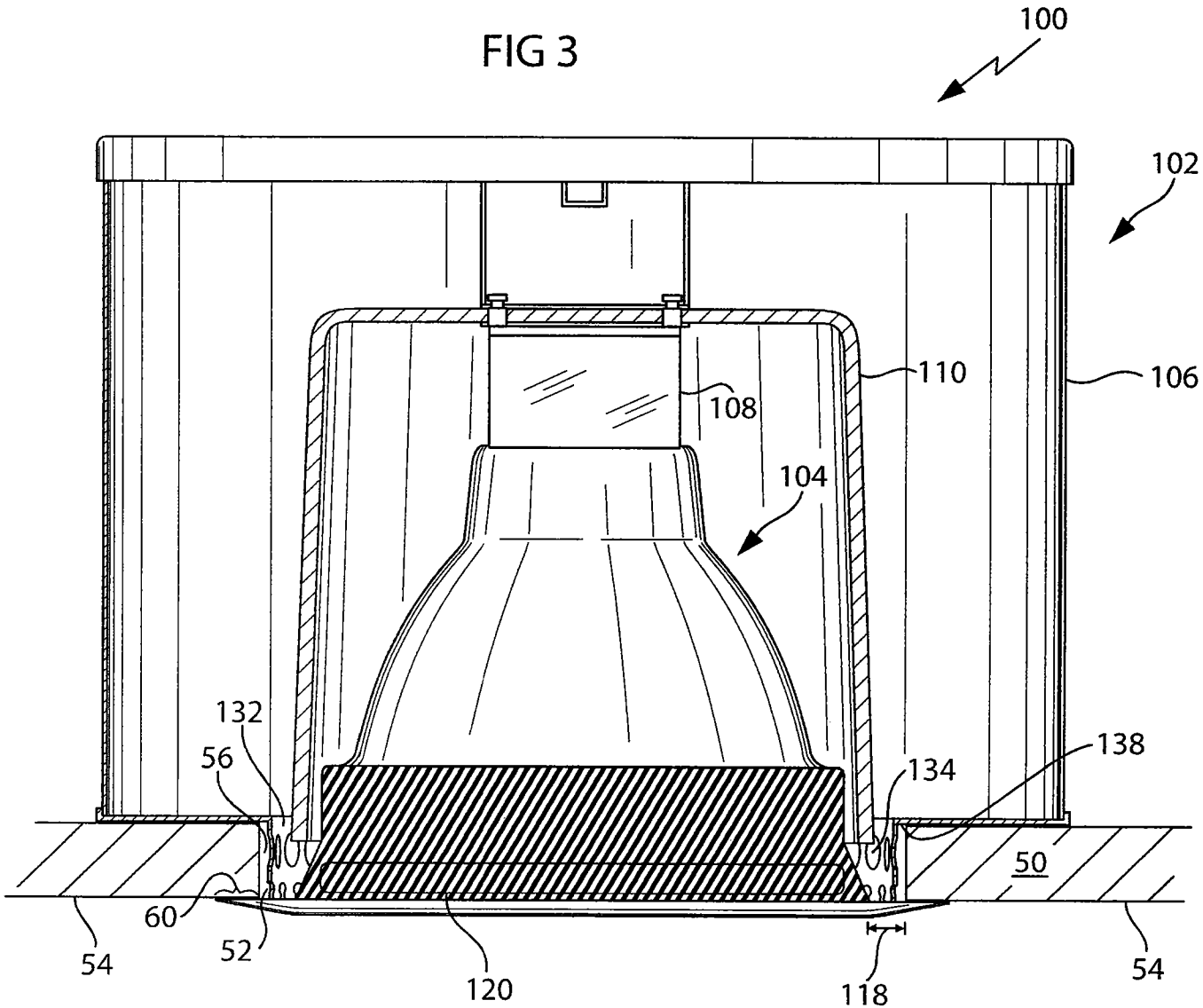
FIG. 3 is a side view with a cutaway portion of the lighting assembly in FIG. 1, Where the trim is installed in relation to the light fixture to cover the opening in the surface of the structure in accordance with the present invention.

FIG. 1 depicts the lighting assembly 100 before installation of the light fixture 102 in or above a structure 50 as shown in FIGS. 2-3. The structure 50 may be a ceiling, a floor, or a wall of a room that is attached to joists, rafters, I-beams, studs, headers, or other building support members. The lighting fixture 102 includes a housing 106, which may be made from steel and/or heat resistant material or fire resistant material. The housing 106 has an open end 107 (see FIG. 2) and a lamp socket 108 positioned relative to the open end 107 such that such that a lamp not shown in the figures) may be installed in the socket 108 of the light fixture through the open end 107. In one implementation, the lighting assembly 100 may include an internal housing 110 disposed within the housing 106 and made from reflective, insulating, or heat resistant material to inhibit heat from a lamp installed in the socket 108 from reaching the housing 106 or at least minimizing its radiation outside the housing 106. In this implementation, the internal housing 110 has an open end 111 (see FIG. 2) disposed in proximity to and encompassed by the open end 107 of the housing 106.

As shown in FIG. 2, the light fixture 102 is disposed in relation to an opening 52 defined in a surface 54 of the structure 50 before installation of the trim 104 such that a lamp may be installed in the light fixture 102 through the opening 52 of the structure and the open end 107 of the light fixture 102 housing 106. A builder or installer may cut the opening 52 in the structure 50 after attaching the light fixture 102 to the building support members located on the same side of structure 50 as the light fixture 102. Alternatively, the builder or installer may pre-cut the opening 52 in a portion of the structure 50 (e.g., a sheet of drywall for forming a ceiling) before installing the portion of the structure 50 such that the opening 52 is aligned with the open end 107 of the light fixture 102.

Figure 4:
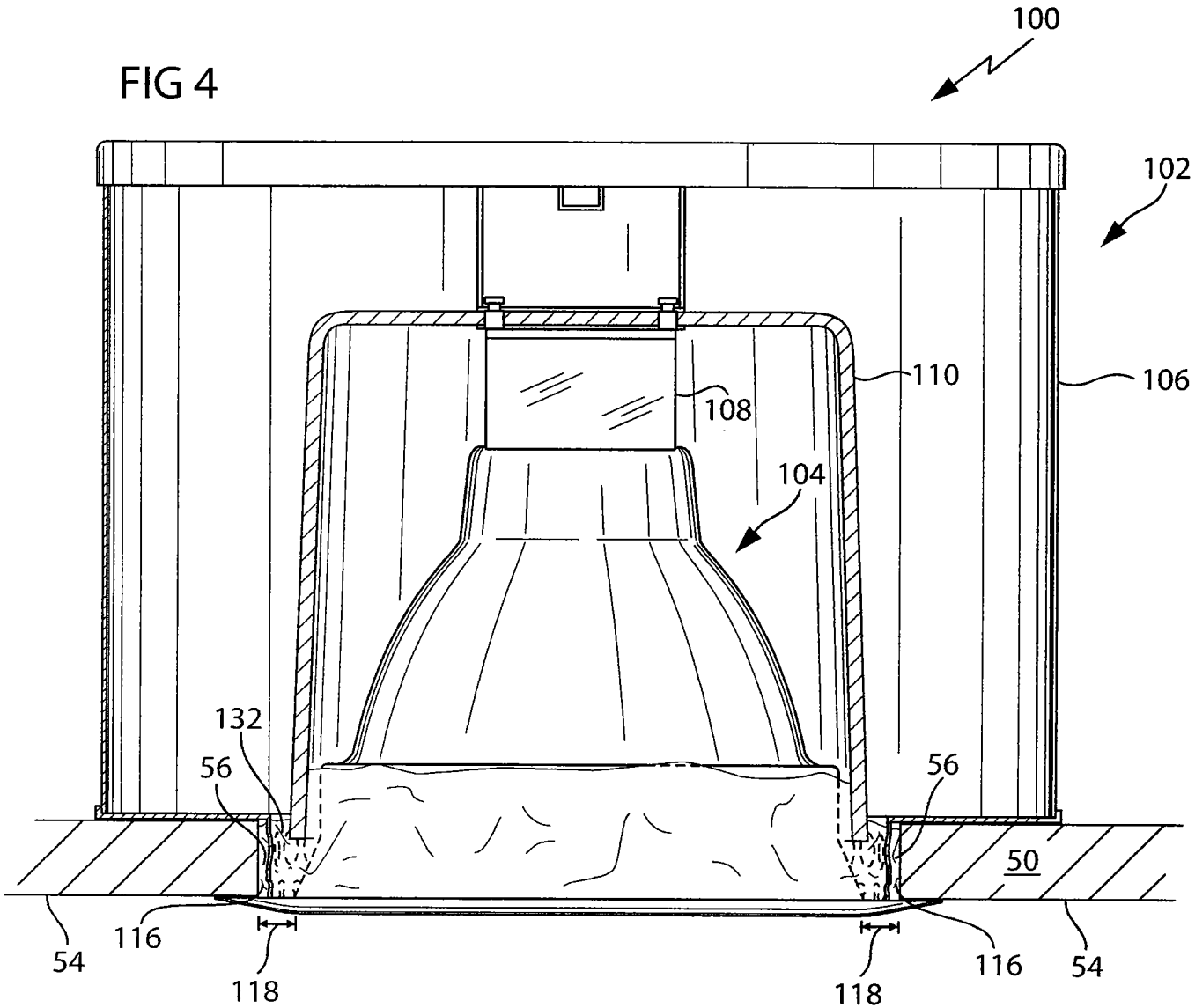
FIG. 4 is another side view with a cutaway portion of the lighting assembly in FIG. 1 in which the intumescent layer has expanded in accordance with the present invention to form a fire resistant seal between the trim and an edge of the opening in the surface of the structure.

The trim 104 has an outer surface 112. An intumescent layer 114 layer is disposed about at least a portion (e.g., 120 in FIG. 3) of the outer surface 112. The trim 104 is adapted to engage the light fixture 102 so that the outer surface 112 of the trim 104 is disposed in proximity to the opening 52 in the structure 50. As shown in FIG. 4, the intumescent layer 114 is adapted to expand to form a fire resistant seal 116 between the trim 104 and the structure 50 when the intumescent layer 114 reaches a predetermined temperature, such as 300° or more, that may be reached when a fire is burning near the structure 50. In this manner, the seal 116 inhibits the spread of fire through the opening 52 in the structure 50. The intumescent layer 114 may be a layer made from a Firefilm®II material available from A/D Fire Protection Systems, a Nullifire material available from The Carboline Company, a SRAYFILM™ WB3 material available CAFCO® Industries, Inc., or other commercially available intumescent fire resistive coating material. The intumescent layer 114 may be brushed, rolled, sprayed, or applied to the outer surface 112 of the trim 104 using another known technique (e.g., a separately applied film or as part of fire resistant label). The trim 104 may be manufactured to incorporate the intumescent layer 114 into at least a portion (e.g., portion 120 in FIG. 3) of the outer surface of the trim 104.

The intumescent layer 114 has a thickness sufficient to enable the layer 114 to expand a gap 118 between the outer surface 112 of the trim 104 and an internal wall 56 of the structure 50 extending along a periphery of the opening 52. In one implementation, the intumescent layer 114 has a thickness of 1/16 inches such that the layer 114 may expand a gap 118 that is equal to or less than seven times the thickness of the intumescent layer 114. In one implementation, the light fixture may have a label or marking (not shown in figures) to identify to the installer a diameter limit for the opening 52 so the gap 118 is within a predetermined width corresponding to the thickness of the intumescent layer 114. In another implementation, the trim 104 may include a flange 136 adapted to extend over a portion 60 (see FIG. 3) of the structure surface 54 so that an installer may confirm that the gap 118 is covered by the flange 136. In this implementation, the flange 136 may have a width (i.e., the dimension corresponding to the gap 118) that is within the expansion limit of the intumescent layer 114.

In FIG. 1, the intumescent layer 114 is shown partially applied to the outer surface 112. In FIGS. 2-3, the intumescent layer 114 is shown applied continuously around the periphery of the outer surface 112 of the trim 104. However, the intumescent layer 114 may be applied to one or more segments or portions 120 of the outer surface 112 of the trim 104 such that the intumescent layer 114 forms the seal 116 when the intumescent layer 114 reaches the predetermined temperature and expands in accordance with the present invention.

The trim 104 is adapted to engage the light fixture 102 such that at least the portion 120 of the outer surface 112 of the trim 104 on which the intumescent layer 114 is disposed is positioned in proximity to the internal wall 56 or an edge 58 defined by the internal wall 56 and the surface 54 of the structure 50. In one implementation shown in FIG. 2, the light fixture 102 has one or more fasteners 122 (only one fastener 122 in view in FIG. 2) and the trim 104 includes a first end 124 having a mating recess 126 for each fastener 122. Each mating recess 126, which may have a key hole or other shape, is adapted to receive and retain a respective fastener 122 such that the light fixture 102 is keyed to accept the trim 104. In another implementation, the light fixture 102 may have a key pattern that includes a post or male thread pattern and the trim 104 may have a key retention pattern that includes a recess or female thread pattern that mates with the post or male thread pattern of the light fixture 102. Thus, the lighting fixture 102 may be designed to have a key pattern (e.g., fastener 122 or pattern of fasteners 122) and the trim 104 may be designed to have a corresponding key retention pattern (e.g., the mating recess 126 or pattern of mating recesses 126) such that the trim 104 is advantageously not interchangeable with standard or conventional trims, eliminating any potential for violating the fire rating for the lighting assembly 100. One of ordinary skill in the art would understand that standard or conventional trims are typically retained by torsion springs, coil springs, or other common trim engagement and retention means that would not allow the standard or conventional trims to be interchangeable with the trim 104 having the key retention pattern 122 corresponding to the light fixture's key pattern 122.

In the implementation shown in FIGS. 1-4, the trim 104 includes a reflector 128 and a trim ring 130 attached to the reflector 128. The trim ring 130 incorporates the portion 120 of the outer surface 112 on or in which the intumescent layer 114 is disposed. In this implementation, the reflector 128 is adapted to removeably attach the trim 104 to the light fixture 102 such that the intumescent layer 114 is disposed in proximity to the internal wall 56 or the edge 58 of the surface 54 of the structure 50 in accordance with the present invention. However, in another implementation, the reflector 128 is not incorporated in the trim 104. In this implementation, the trim ring 130 may have the key retention pattern or mating recess 126, enabling the trim ring 130 to removeably engage the trim 104 to the light fixture 102 such that the intumescent layer 114 is disposed in proximity to the internal wall 56 or the edge 58 of the surface 54 of the structure 50 in accordance with the present invention.

In one implementation shown in FIG. 2, the lighting fixture housing 106 includes a flange 132 having one or more apertures 134. The flange 132 extends from the open end 107 of the light fixture 102 into the opening 52 of the structure 50 such that the flange 132 is disposed between the internal wall 56 of the structure 50 and the outer surface 112 of the trim 104 such that the intumescent layer 114 is able to expand through the apertures 134 of the flange 132 to form the seal 116 in accordance with the present invention. The flange 132 may function as a plaster ring to provide an installer with a guide for forming the opening 52 in the surface 54 of the structure 50 in addition, since the flange 132 has the holes or apertures 134, the intumescent layer 114 on the outer surface 112 of the trim 104 may still expand through the apertures 134 to form the seal 116 between the structure surface 54 and the trim 104 when the intumescent layer 114 reaches the predetermined temperature, inhibiting the spread of a fire through the lighting assembly 100.

As discussed above, the trim 104 or trim ring 130 may also include a flange 136 adapted to extend over a portion 60 (see FIG. 3) of the structure surface 54. In this implementation, the flange 136 may incorporate; the portion 120 of the outer surface 112 of the trim 104 on which the intumescent layer 114 is disposed such that the seal 116 is found between the flange 136 and the portion 60 of the structure surface 54, inhibiting the spreading of a fire through the lighting assembly 100.

The lighting assembly 100 may be used in installations where the lighting fixture housing 106 is in contact with insulation or not in contact with insulation. In addition, the trim 104 may include a lens, baffle, and/or diffuser not shown in the figures.

As shown in the implementation shown in FIGS. 1-4, the lighting fixture 102 may have a bottom 138 that includes the open end 107 from which the flange 132 extends. In this implementation, the lighting assembly 100 is adapted for new installations in a room in which the lighting fixture 102 is installed before the structure 50 (e.g., a sheet of drywall for forming a ceiling) is installed or attached to support members (e.g., ceiling joists).

Figure 5:
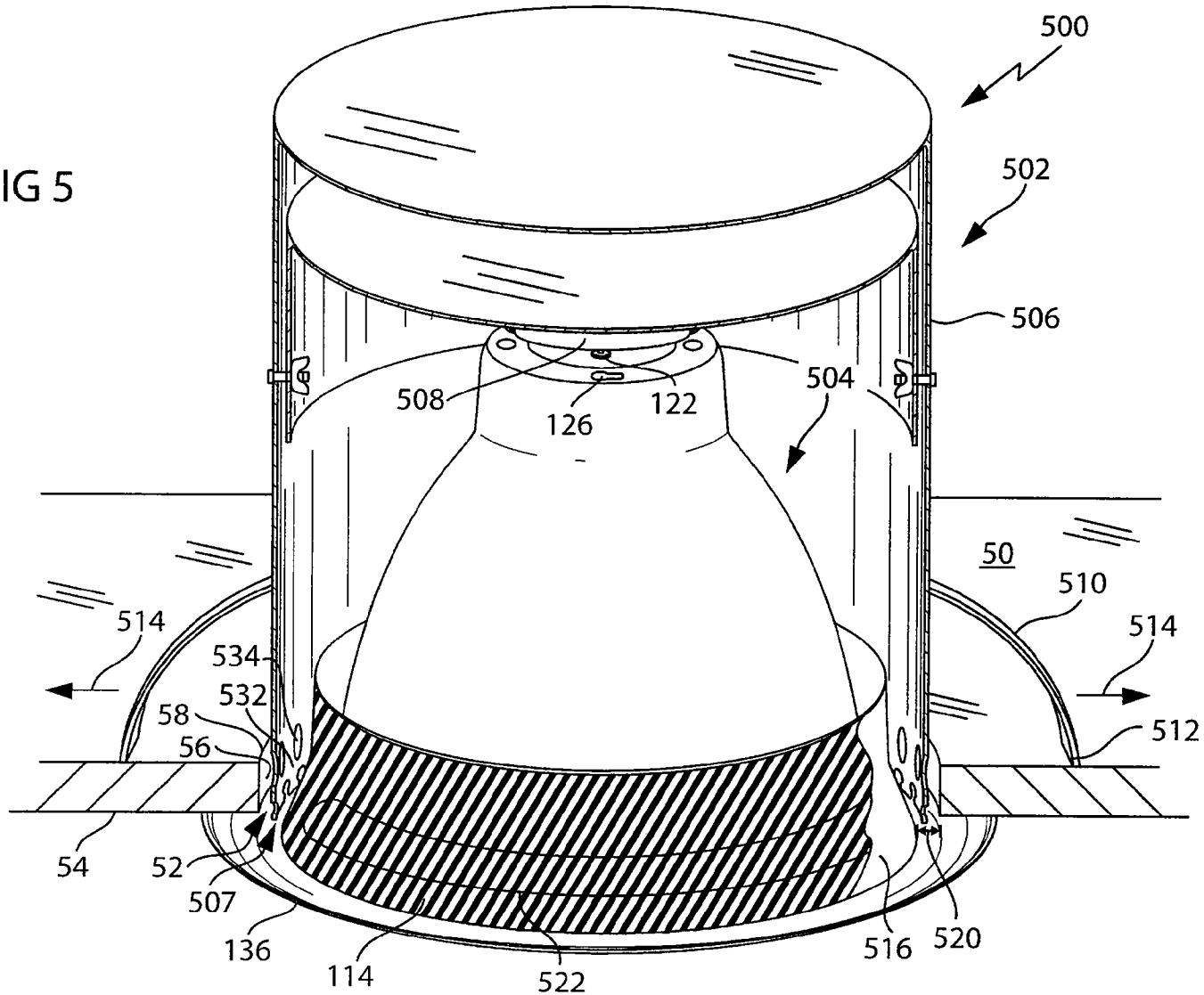
FIG. 5 is a perspective view with a cutaway portion of another embodiment of a lighting assembly including a light fixture and a trim having a intumescent layer consistent with the present invention.
Figure 6:
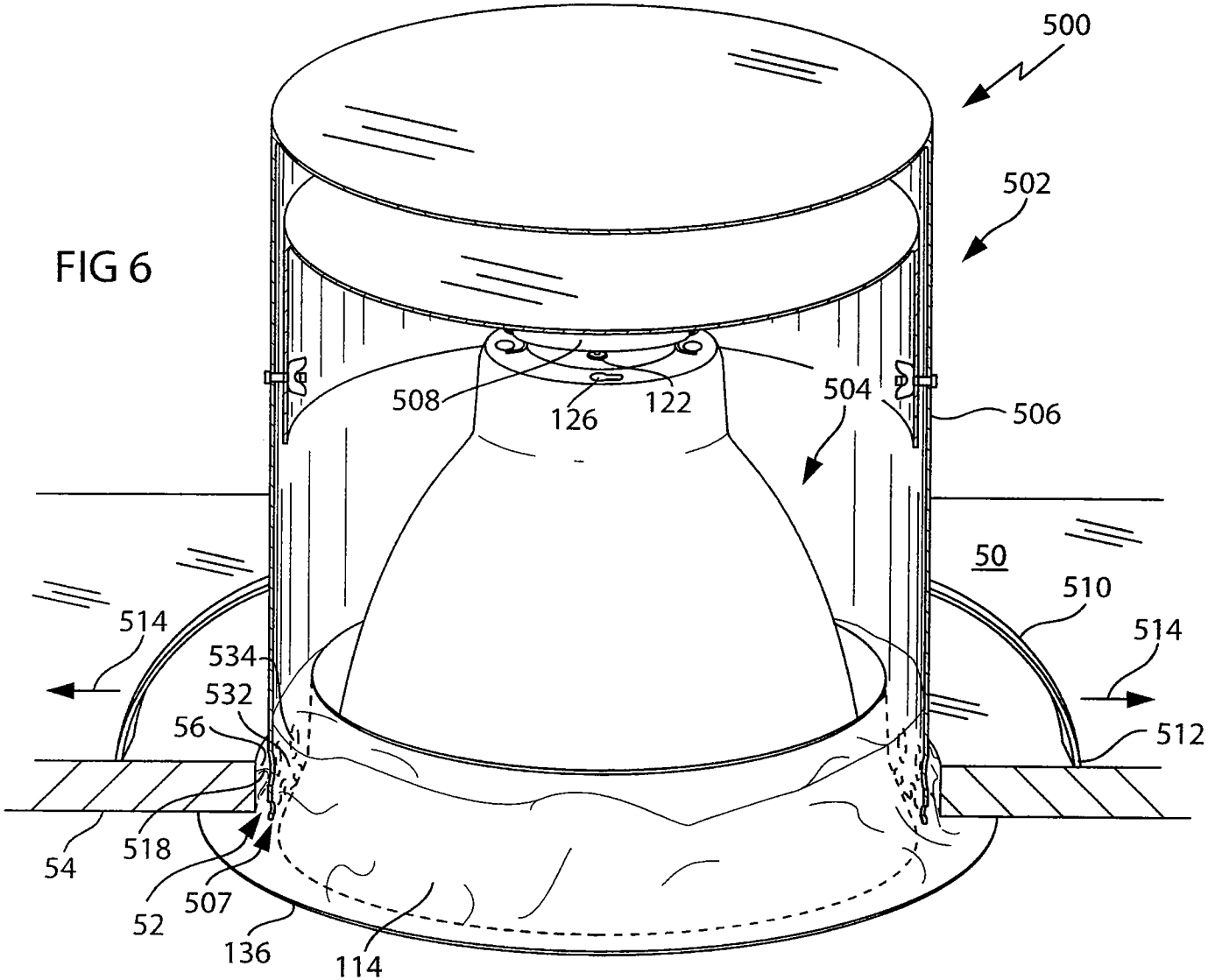
FIG. 6 is another perspective view with a cutaway portion of the lighting assembly in FIG. 5 in which the intumescent layer has expanded in accordance with the present invention to form a fire resistant seal between the trim and an edge of the opening in the surface of the structure.

FIGS. 5-6 depict another embodiment of a lighting assembly 500 consistent with the present invention in which the lighting assembly 500 is suitable for installation in a pre-existing structure 70, such as in a room to be remodeled. The lighting assembly 500 includes a light fixture 502 and a trim 504, consistent with the trim 104, that is adapted to mate with or be installed on the light fixture 502. The lighting fixture 502 includes a housing 506, which may be made from steel, and/or other heat resistant material or fire resistant material. The housing 506 has an open end 507 and a lamp socket 508 positioned relative to the open end 507 such that such that a lamp (not shown in the figures) may be installed in the socket 508 of the light fixture through the open end 507, The light fixture 502 is disposed in relation to an opening 52 defined in a surface 54 of a structure 50 before installation of the trim 504 such that a lamp may be installed in the light fixture 502 through the opening 52 of the structure and the open end 507 of the light fixture 502 housing 506. A builder or installer may cut the opening 52 in the structure 50 before making electrical connections to the light fixture 502 and Inserting the light fixture 502 into the opening 52. The light fixture 502 includes a plurality of legs 510 disposed about the external perimeter of the housing 506 and orthogonal to the open end 507 of the light fixture. Each of the legs 510 has a distal end 512 disposed near the open end 107 of the light fixture. Each distal end 512 is normally biased to move away from the housing 506 such that, when the light fixture 502 is inserted into the structure 50 opening 52, the distal end 512 of each leg 510 is moved towards the housing 506 by the internal wall 56 of the structure 50 opening 52. When the distal end 512 of each leg 510 clears the internal wall 56 of the structure 50 opening 52, the distal end 512 of each leg 510 is biased away from the housing 506 (as shown by arrow 514 in FIG. 5) such that the light fixture 502 is held in place in relation to the structure 50 opening 52 by the legs 510.

Like the trim 104, the trim 504 has an intumescent layer 114 on the outer surface 516 of the trim 504, The trim 504 is adapted to engage the light fixture 502 so that the outer surface 516 of the trim 104 is disposed in proximity to the opening 52 in the structure 50. As shown in FIG. 6, the intumescent layer 114 is adapted (e.g., heat activated) to expand to form a fire resistant seal 518 between the trim 504 and the structure 50 when the intumescent layer 114 reaches a predetermined temperature, such as 300° or more, from a fire or other heat source near the structure 50. The seal 518 inhibits the spread of fire through the opening 52 in the structure 50. The intumescent layer 114 may be brushed, rolled, sprayed, or applied using another known technique to have a thickness sufficient to enable the layer 114 to expand a gap 520 between the outer surface 516 of the trim 504 and an internal wall 56 of the structure 50 extending along a periphery of the opening 52.

The trim 104 is adapted to engage the light fixture 102 such that at least a portion 522 of the outer surface 516 of the trim 504 on which the intumescent ladder 114 is disposed is positioned in proximity to the internal wall 56 or an edge 58 defined by the internal wall 56 and the surface 54 of the structure 50. The light fixture 502 may have a key pattern (e.g., fastener 122 or pattern of fasteners 122) and the trim 504 may have a corresponding key retention pattern (e.g., the mating recess 126 or pattern of mating recesses 126) such that the trim 104 is not interchangeable with standard or conventional trims as discussed herein.

In one implementation, the lighting fixture housing 506 includes a lower portion 532 having one or more apertures 534. The lower portion 532 is disposed near the open end 507 of the light fixture 502 and is adapted to extend into the structure opening 52 when the light fixture 502 is installed (e.g., the distal end 512 of each leg 510 is clear of the internal wall 56) such that the lower portion 532 is disposed between the internal wall 56 of the structure 50 and the outer surface 112 of the trim 504. In this implementation, the intumescent layer 114 is able to expand through the apertures 534 of the flange 532 to form the seal 518 in accordance with the present invention to inhibit the spreading of a fire through the lighting, assembly 500.

Figure 7:
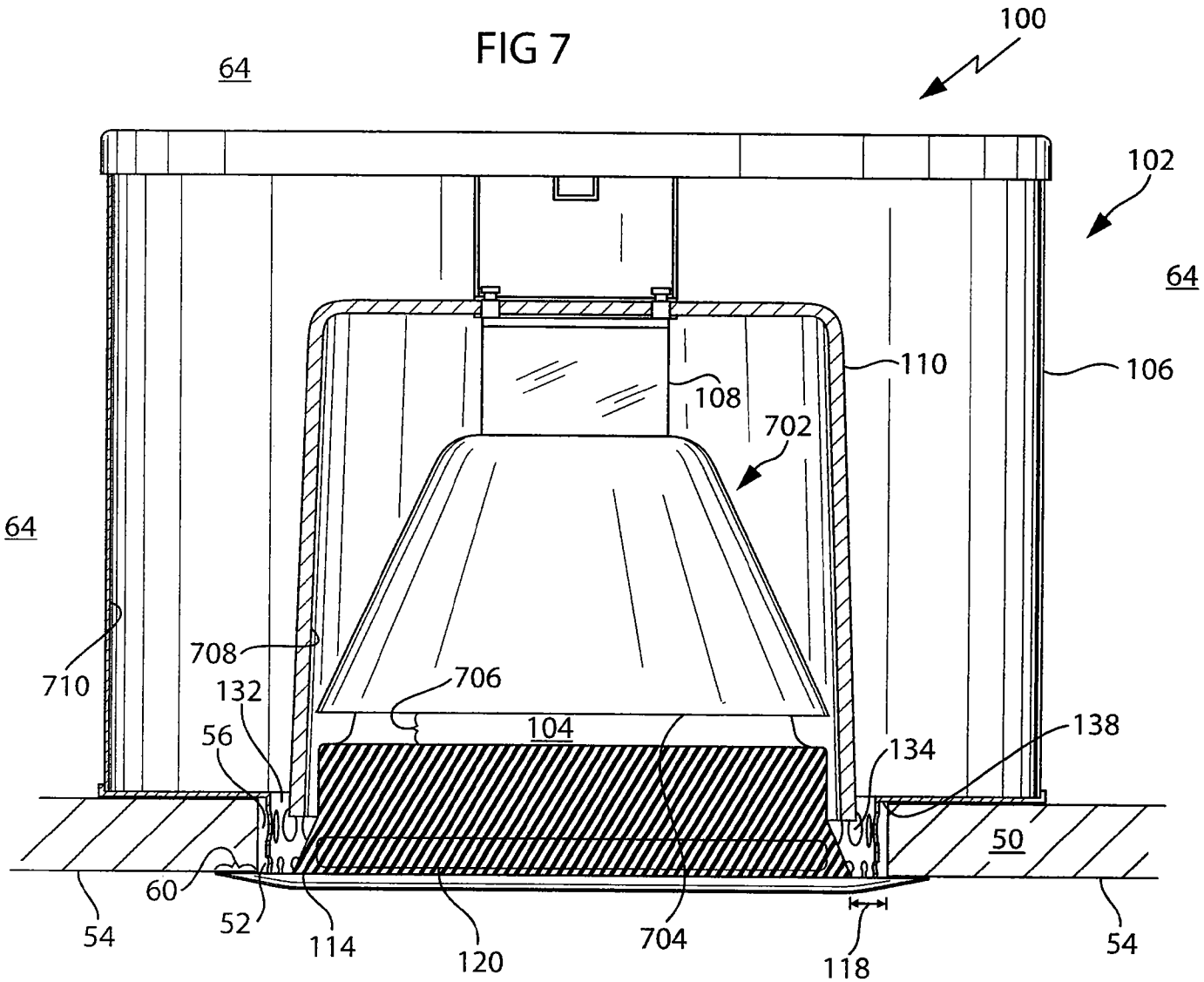
FIG. 7 is a side view with a cutaway portion of the lighting assembly in FIG. 1, where the light assembly has an insulator disposed between the light fixture and the trim to inhibit heat from transferring via the trim through the lighting assembly to an area above the surface of the structure.
Figure 8:
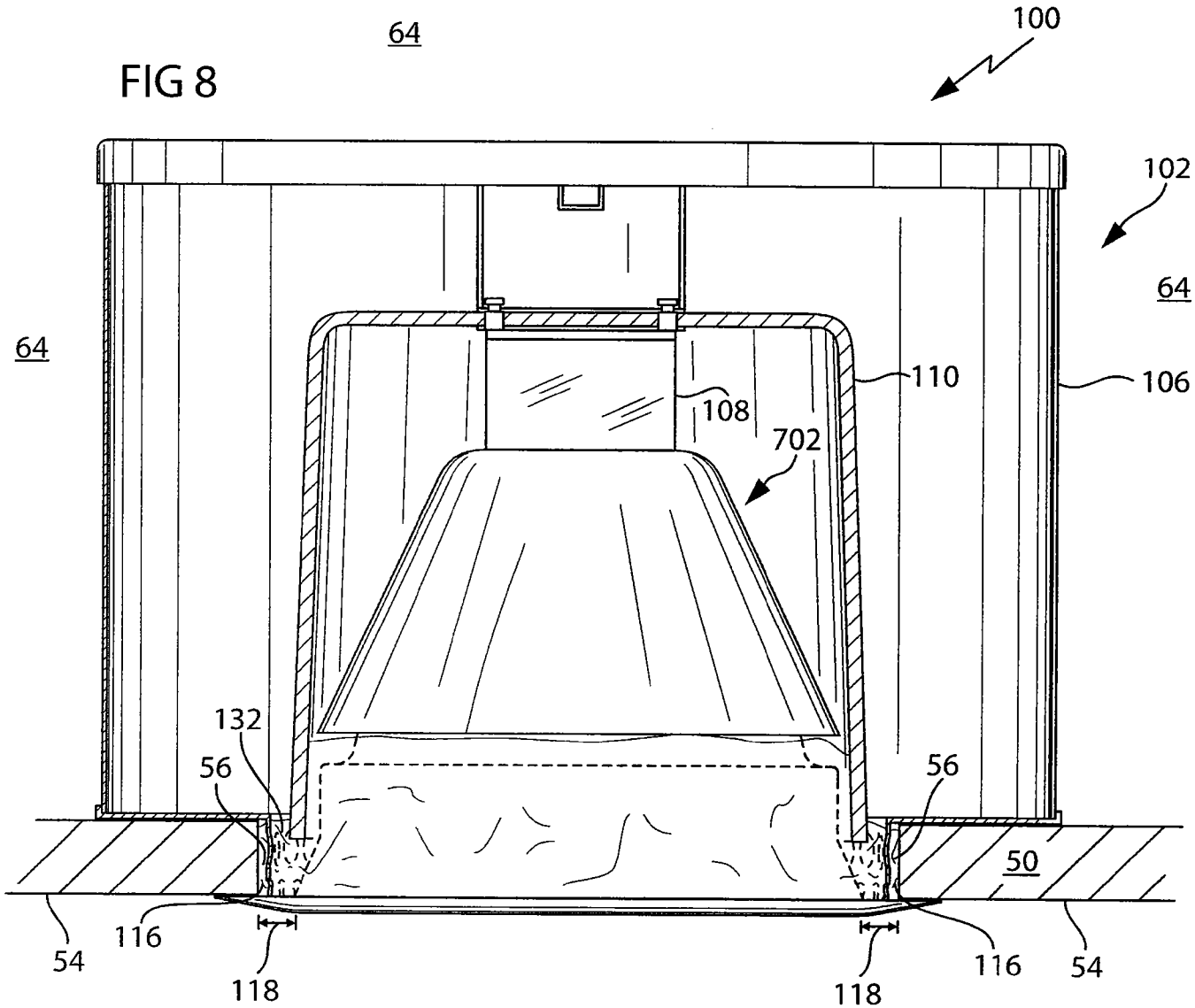
FIG. 8 is another side view with a cutaway portion of the lighting assembly in FIG. 7 in which the intumescent layer has expanded in accordance with the present invention to form a fire resistant seal between the trim and an edge of the opening in the surface of the structure in proximity to the insulator.

As shown in FIGS. 7 and 8, a light assembly consistent with the present invention (e.g., light assembly 100 or 500) may also include an insulator 702 or heat-resistant barrier disposed between the light fixture 102 or 502 and the trim 104 or 504 to inhibit heat from transferring via the trim 104 or 504 through the lighting assembly to an area 62 above the surface 54 of the structure 50. In the implementation shown in FIG. 7, the insulator 702 is adapted to cover at least a portion of the trim 104 corresponding to the reflector 128. In this implementation, an end 704 of the insulator may be disposed along an external perimeter of the trim 104 and a predetermined distance 706 from the intumescent layer 114 such that, when the intumescent layer 114 expands, the seal 116 is in proximity to or abuts the insulator 704 as shown in FIG. 8. The insulator 702 may comprise a plastic or other heat-resistant material and need not be fire resistant or flame; retardant. The insulator 702 may be removeably attached to the light fixture 102 in the same manner as the trim 104, be affixed to the trim 104 before installation of the trim into the light fixture 102, or be affixed to an internal surface of the light fixture 102, such an internal surface 708 of the internal housing 110 or an internal surface 710 of the external housing 106. In the implementation shown in FIGS. 7 and 8, the insulator 702 is conical shaped. However, the insulator 702 may have a cylindrical shape or another shape such as a embodiment. When the insulator 702 is installed in the light fixture 102, at least the end 704 of the insulator 702 is proximate to (or abuts) and follows a contour of the internal surface 708 or 710 of the internal housing 110 or the external housing 106 such that the insulator effectively inhibits heat from transferring via the trim 104 through the lighting assembly 100 beyond the internal housing 110 or the external housing 106.

While various embodiments of the present invention have been described, it will be apparent to those of skill in the art that many more embodiments and implementations are possible that are within the scope of this invention. Accordingly, the present invention is not to be restricted except in light of the attached claims and their equivalents.

What is claimed is:

1. A lighting assembly, comprising:

a light fixture adapted to be disposed in relation to an opening defined in a surface of a structure such that a lamp may be installed in the light fixture through the opening;

a trim having an outer surface, the trim being adapted to engage the light fixture so that the outer surface of the trim is disposed in proximity to the opening in the structure; and an intumescent layer disposed about at least a portion of the outer surface of the trim, the intumescent layer being adapted to expand to form a fire resistant seal between the trim and the structure when the intumescent layer reaches a predetermined temperature.

2. A lighting assembly as set forth in claim 1, wherein the trim has a flange adapted to extend over a portion of the structure surface defining the opening and the intumescent layer is on the flange.

3. A lighting assembly as set forth in claim 1, wherein the structure has an internal wall extending along a periphery of the opening and the trim is adapted to engage the light fixture such that the portion of the outer surface of the trim on which the intumescent layer is disposed is positioned in proximity to the internal wall of the structure.

4. A lighting assembly as set forth in claim 3, wherein the lighting fixture further comprises an open end and a flange having a plurality of apertures, the flange being adapted to extend from the open end of the lighting fixture into the opening defined in the structure surface such that the flange is disposed between the internal wall of the structure and the portion of the outer surface of the trim on which the intumescent layer is disposed, wherein the intumescent layer is adapted to expand through the apertures of the flange to form the seal.

5. A lighting assembly as set forth in claim 3, wherein the lighting fixture further comprises an open end and a lower portion disposed near the open end, the lower portion of the lighting fixture having at least one aperture, the lower portion being adapted to extend into the opening defined in the structure surface such that the lower portion is disposed between the internal wall of the structure and the portion of the outer surface of the trim on which the intumescent layer is disposed, wherein the intumescent layer is adapted to expand through the at least one aperture of the lower portion of the lighting fixture to form the seal.

6. A lighting assembly as set forth in claim 1, wherein the trim further comprises a reflector and a trim ring attached to the reflector, the trim ring incorporating the portion of the outer surface on which the intumescent layer is disposed.

7. A lighting assembly as set forth in claim 6, wherein the reflector is adapted to removeably attach the trim to the light fixture.

8. A lighting assembly as set forth in claim 7, wherein the light fixture has a fastener and the reflector includes a first end having a mating recess adapted to receive and retain the fastener such that the light fixture is keyed to accept the trim.

9. A lighting assembly as set forth in claim 1, further comprising a heat-resistant barrier disposed between the light fixture and the trim to inhibit heat from transferring via the trim through the lighting assembly to an area above the surface of the structure.

10. A lighting assembly as set forth in claim 9, wherein the heat-resistant barrier is adapted to cover at least a portion of the trim.

11. A lighting assembly as set forth in claim 9, wherein the heat-resistant barrier has an end disposed a predetermined distance from the intumescent layer such that, when the intumescent layer expands, the seal is in proximity to the heat-resistant barrier.

12. A lighting assembly as set forth in claim 9, wherein the light fixture further comprises a housing having an internal surface and the heat-resistant barrier has at least one end disposed in proximity to the internal surface of the housing.

13. A lighting assembly as set forth in claim 12, wherein the one end of the heat-resistant barrier follows a contour of the internal surface of the housing.

14. A trim for mating to a lighting fixture of a lighting assembly, the light fixture being adapted to be disposed in relation to an opening defined in a surface of a structure such that a lamp may be installed in the light fixture through the opening, the trim comprising:

an outer surface, the trim being adapted to engage the light fixture so that the outer surface of the trim is disposed in proximity to the opening in the structure; and an intumescent layer disposed about at least a portion of the outer surface of the trim, the intumescent layer being adapted to expand to form a fire resistant seal between the trim and the structure when the intumescent layer reaches a predetermined temperature.

15. A trim as set forth in claim 14, wherein the trim has a flange adapted to extend over a portion of the structure surface defining the opening and the intumescent layer is on the flange.

16. A trim as set forth in claim 14, wherein the structure has an internal wall extending along a periphery of the opening and the trim is adapted to engage the light fixture such that the portion of the outer surface of the trim on which the intumescent layer is disposed is positioned in proximity to the internal wall of the structure.

17. A trim as set forth in claim 16, wherein the lighting fixture comprises an open end and a flange having a plurality of apertures, the flange being adapted to extend from the open end of the lighting fixture into the opening defined in the structure surface such that the flange is disposed between the internal wall of the structure and the portion of the outer surface of the trim on which the intumescent layer is disposed, wherein the intumescent layer is adapted to expand through the apertures of the flange to form the seal.

18. A trim as set forth in claim 16, wherein the lighting fixture comprises an open end and a lower portion disposed near the open end, the lower portion of the lighting fixture having at least one aperture, the lower portion being adapted to extend into the opening defined in the structure surface such that the lower portion is disposed between the internal wall of the structure and the portion of the outer surface of the trim on which the intumescent layer is disposed, wherein the intumescent layer is adapted to expand through the at least one aperture of the lower portion of the lighting fixture to form the seal.

19. A trim as set forth in claim 14, wherein the trim further comprises a reflector and a trim ring attached to the reflector, the trim ring incorporating the portion of the outer surface on which the intumescent layer is disposed.

20. A trim as set forth in claim 19, wherein the reflector is adapted to removeably attach the trim to the light fixture.

21. A trim as set forth in claim 20, wherein the light fixture has a fastener and the reflector includes a first end having a mating recess adapted to receive and retain the fastener such that the trim is keyed to be accepted by the light fixture.

22. A trim as set forth in claim 14, wherein the light assembly further comprises a heat-resistant barrier disposed between the light fixture and the trim to inhibit heat from transferring via the trim through the lighting assembly to an area above the surface of the structure.

23. A trim as set forth in claim 22, wherein the heat-resistant barrier is adapted to cover at least a portion of the trim.

24. A trim as set forth in claim 22, wherein the heat-resistant barrier has an end disposed a predetermined distance from the intumescent layer such that, when the intumescent layer expands, the seal is in proximity to the heat-resistant barrier.

25. A trim as set forth in claim 22, wherein the light fixture further comprises a housing having an internal surface and the heat-resistant barrier has at least one end disposed in proximity to the internal surface of the housing.

26. A trim as set forth in claim 24, wherein the one end of the heat-resistant barrier follows a contour of the internal surface of the housing.

27. A trim for mating to a lighting fixture of a lighting assembly, the light fixture being adapted to be disposed in relation to an opening defined in a surface of a structure such that a lamp may be installed in the light fixture through the opening the trim comprising:

an outer surface, the trim being adapted to engage the light fixture so that the outer surface of the trim is disposed in proximity to the opening in the structure; and a heat-resistant barrier disposed between the light fixture and the trim to inhibit heat from transferring via the trim through the lighting assembly to an area above the surface of the structure.

* * * * *